US008526849B2

(12) United States Patent
Yoshida et al.

(10) Patent No.: US 8,526,849 B2
(45) Date of Patent: Sep. 3, 2013

(54) PROCESS CARTRIDGE AND IMAGE FORMING APPARATUS

(75) Inventors: Tomofumi Yoshida, Osaka (JP); Hirobumi Ooyoshi, Osaka (JP); Yoshiyuki Shimizu, Hyogo (JP); Shinichi Arasawa, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 461 days.

(21) Appl. No.: 12/805,822

(22) Filed: Aug. 20, 2010

(65) Prior Publication Data

US 2011/0052255 A1 Mar. 3, 2011

(30) Foreign Application Priority Data

Aug. 27, 2009 (JP) ..... 2009-196394

(51) Int. Cl.
*G03G 21/16* (2006.01)
*G03G 15/04* (2006.01)

(52) U.S. Cl.
USPC ..... 399/111; 399/119

(58) Field of Classification Search
USPC ..... 399/111, 114, 119, 167
See application file for complete search history.

(56) References Cited

U.S. PATENT DOCUMENTS

| | | | | |
|---|---|---|---|---|
| 6,731,893 | B2 * | 5/2004 | Okoshi | 399/119 |
| 7,424,263 | B2 | 9/2008 | Shimizu et al. | |
| 7,623,821 | B2 | 11/2009 | Kubota et al. | |
| 7,634,213 | B2 | 12/2009 | Yoshida et al. | |
| 7,676,184 | B2 | 3/2010 | Murayama et al. | |
| 7,706,724 | B2 | 4/2010 | Kawakami et al. | |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145119 | A1 | 6/2008 | Tatsumi et al. | |
| 2008/0170898 | A1 | 7/2008 | Shimizu et al. | |
| 2008/0181692 | A1 | 7/2008 | Tatsumi et al. | |
| 2008/0187358 | A1 | 8/2008 | Kubota et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2008/0279581 | A1 | 11/2008 | Shimizu et al. | |
| 2008/0279586 | A1 | 11/2008 | Tatsumi et al. | |
| 2009/0022531 | A1 | 1/2009 | Kubota et al. | |
| 2009/0110430 | A1 | 4/2009 | Kubota et al. | |
| 2009/0154973 | A1 | 6/2009 | Shimizu et al. | |
| 2009/0162101 | A1 | 6/2009 | Yoshida et al. | |
| 2009/0169246 | A1 | 7/2009 | Ooyoshi et al. | |
| 2009/0169265 | A1 | 7/2009 | Yoshida et al. | |
| 2010/0028045 | A1 | 2/2010 | Kawakami et al. | |
| 2010/0202796 | A1 | 8/2010 | Ooyoshi et al. | |

FOREIGN PATENT DOCUMENTS

| | | |
|---|---|---|
| JP | 2008-139818 | 6/2008 |

* cited by examiner

*Primary Examiner* — Walter L Lindsay, Jr.
*Assistant Examiner* — Rodney Bonnette
(74) *Attorney, Agent, or Firm* — Harness, Dickey & Pierce

(57) ABSTRACT

A process cartridge collectively accommodates at least a latent image carrier and a developer carrier carrying tonner for visualizing an electrostatic latent image formed on the latent image carrier and includes a side plate unit rotatably supporting the latent image carrier and the developer carrier. The side plate includes a bearing that rotatably supports a rotation shaft of the developer carrier; an elastic body that pushes the bearing against a rotation shaft of the latent image carrier; and a guiding unit that guides the bearing in a direction of the pushing. The guiding unit includes an abrasion preventing structure at a wall surface of the guiding unit that comes in contact with the bearing.

9 Claims, 9 Drawing Sheets

PROCESS CARTRIDGE AND IMAGE FORMING APPARATUS

CROSS-REFERENCE TO RELATED APPLICATIONS

The present application claims priority to and incorporates by reference the entire contents of Japanese Patent Application No. 2009-196394 filed in Japan on Aug. 27, 2009.

BACKGROUND OF THE INVENTION

1. Field of the Invention

The present invention relates to a process cartridge and an image forming apparatus using the same and more specifically relates to a shaft support mechanism for a rotary member.

2. Description of the Related Art

An image forming apparatus employing an electrophotography system forms an electrostatic latent image on a photosensitive element used as a latent image carrier according to image information, performs a visualization process of the electrostatic latent image using toner supplied from a developing device, and then transfers the resultant image.

There are image forming apparatuses configured to form an image not only in a single color but also in a plurality of colors. These image forming apparatuses are classified into two types with respect to transfer process, i.e., one which subsequently transfers different color toner images onto an intermediate transfer member, and the other which superimposes and transfers different color toner images onto a transfer paper fed from a paper feed device.

For example, a structure called a tandem system in which a belt is used as an intermediate transfer member or as a conveying member that conveys a transfer paper, and a plurality of image forming units are arranged in parallel along the stretched surfaces of the belt are known as the structure that forms an image in the colors.

Each of the image forming units includes a photosensitive element and a charger, a writing device, a developing device, and a cleaning device that perform an image forming process on the photosensitive element. The cleaning device removes the toner being left untransferred on the photosensitive element that has completed the transfer.

A device that works with the photosensitive element included in the image forming unit is a developing device that includes a developing roller as a developer carrier rotating with facing the photosensitive element.

The developing roller has a developer layer with a predetermined thickness on its surface and performs a visualization process of electrostatic latent images by making the developer layer contact with the electrostatic latent images supported on the surface of the photosensitive element. In such a manner, the position of the developing roller is determined with a narrow gap formed between the developing roller and the surface of the photosensitive element. Moreover, the developing roller and the photosensitive element are geared together by intermeshing gears provided at their rotation shafts to rotate the developing roller and the photosensitive element together.

To optimize the determination of the position of the developing roller relative to the photosensitive element, Japanese Patent Application Laid-open No. 2008-139818 discloses, for example, a structure that utilizes the pressing force derived from the own weight of the developing roller by positioning the developing roller above the photosensitive element and obtained from a component of force, which is directed to the surface of the photosensitive element, of rotating force arising from the rotation of the developing roller.

Japanese Patent Application Laid-open No. 2008-139818 discloses structures of the shaft supporting units of rotation shafts as illustrated in FIGS. 4 and 5 that are also used for explaining an embodiment of the present invention.

FIG. 4 illustrates a structure that includes a rotatable bearing 18*a* working with a shaft end 6*h*3 of a support shaft 6*h*0 fitting with a shaft center portion of a roller like developer carrier 6*h* and a block body 18*b* coming in contact with the peripheral surface of the bearing 18*a*. The structure also includes a pressing spring 19 that is arranged between the block body 18*b* and a guiding unit 18*c* for guiding the bearing 18*a* in a direction in which the developer carrier 6*h* comes in contact with and is separated from a photosensitive element as a latent image carrier 6*a* and that has a tendency to push the developer carrier 6*h* against the photosensitive element.

FIG. 5 illustrates a structure that includes a locking portion on which one end of the spring 19 is loaded at a portion of the peripheral surface of the locking portion and that does not rotate as a structure of a bearing (represented as a reference numeral 18*a*' for convenience). With the structure, the shaft end 6*h*3 of the support shaft 6*h*0 is inserted in the bearing 18*a*' to be rotatable.

As illustrated in FIG. 12, force relationship regarding pressing of the developing roller against the surface of the photosensitive element at the shaft supporting unit of the developing roller included in the bearing structure described above is explained using acting force at an engagement position of the gears. In FIG. 12, vectors represented as arrows are force that occurs at the engagement position. However, for convenience, the vectors are illustrated with their base points being at the shaft center of the bearing 18*a* in order to facilitate understanding of the force relationship acting between the bearing 18*a* and the guiding unit 18*c*. The lengths of the arrows indicating the strength of force of the vectors are appropriately changed and are not in a proportional relationship with the actual values.

In FIG. 12, a gear (gear represented as a reference numeral 6*h*-G in FIG. 3 illustrating an embodiment of the present invention) provided at a driving side end of the developer carrier 6*h* employing a developing roller is engaged with a gear (gear represented as a reference numeral 6*a*-G in FIG. 3 illustrating the embodiment) provided at a driving side end of the photosensitive drum 6*a*. Therefore, when a gear (not illustrated) positioning at the image forming apparatus side rotates the photosensitive drum a in an arrow a direction, the developer carrier 6*h* rotates in an arrow b direction.

A driving force 6F1 of the developer carrier 6*h* is a vector in a direction 20 degrees from a tangential direction at a position where the photosensitive drum 6*a* makes contact with the developer carrier 6*h* because the pressure angle of the gear is 20 degrees.

The developer carrier 6*h* presses the bearing (represented as a reference numeral 18*a* for convenience) into which the rotation support shaft of the developer carrier 6*h* is inserted against the guide (represented as a reference numeral 18*c* indicated in FIG. 4 for convenience) by the driving force 6F1. The angle formed by the wall surface of the guiding unit 18*c* and the direction of the driving force 6F1 is designed to be an obtuse angle (90°<) in a direction of the photosensitive drum 6*a*.

With this, the driving force 6F1 at a contact position of the bearing 18*a* and the guiding unit 18*c* is divided into a component force 6F1*a* for driving a developer carrier and a component force 6F1*b* for driving a developer carrier. The component force 6F1*a* for driving a developer carrier acts in a direction perpendicular to the wall surface of the guiding unit 18*c* (this component of force corresponds to the component of force of the rotating force in a tangential direction given to the developer carrier 6*h*), and the component force 6F1*b* for driving a developer carrier acts in a direction parallel to the wall surface of the guiding unit 18*c*.

A force of an own weight 6F2 of the developing device itself is divided at two portions where the developing device makes contact with the guiding unit 18*c* and the photosensitive drum 6*a*. For brevity, only a component force 6F2*b* of own weight of the developing device in a direction at an angle of the wall of the guiding unit 18*c* is illustrated.

A resultant force of the component force 6F1*b* for driving a developer carrier, the component force 6F2*b* of own weight of the developing device, and a pressing force 6F3 by the pressing spring (represented as a reference numeral 19 for convenience) provided in order to push the developer carrier 6*h* against the photosensitive drum 6*a* is divided into components of force. One of the components of force at a contact position of the developer carrier 6*h* and the photosensitive drum 6*a* in a direction connecting the shafts of the developer carrier 6*h* and the photosensitive drum 6*a* becomes a force F by which the developer carrier 6*h* is pushed against the photosensitive drum 6*a*.

As is evident from the explanation given above, the bearing 18*a* maintains a relationship of pushing the developer carrier 6*h* against the photosensitive drum 6*a* by contacting the bearing 18*a* with the wall surface of the guiding unit 18*c* at a portion of the peripheral surface of the bearing 18*a*. The bearing 18*a* is required for a function to maintain an opposed state of the developer carrier 6*h* against the photosensitive drum 6*a* in a proper opposed relationship while absorbing periodical shaft deflection due to eccentricity generated in the photosensitive drum 6*a* and the developer carrier 6*h* themselves or due to displacement of the shaft centers of the gears. For this reason, the bearing 18*a* is periodically reciprocated (a movement in a direction in which the developer carrier comes in contact with and is separated from the photosensitive drum) at the guiding unit 18*c* to absorb the shaft deflection. Such a reciprocating movement is a movement of coming in contact with or being separated from the wall surfaces of the guiding unit. Accordingly, while rotating, the bearing 18*a* periodically slides on the wall surface of the guiding unit 18*c* when they come in contact, and while not rotating, the bearing 18*a* repeats sliding due to the reciprocation.

The repetition of the periodical sliding of the bearing may deform or break a part of the wall surface of the guiding unit 18*c*.

When a part of the wall surface is deformed or broken, the distance between the shafts of the photosensitive drum and the developer carrier are changed. As a result, the supplying state of the developer supported by the developer carrier is changed from its proper state. In other words, the contact state of the development layer with the electrostatic latent images may vary. This may change the supplying state of toner to the electrostatic latent images, causing the excess of density and the insufficiency of density.

SUMMARY OF THE INVENTION

It is an object of the present invention to at least partially solve the problems in the conventional technology.

According to an aspect of the present invention, there is provided a process cartridge that collectively accommodates at least a latent image carrier and a developer carrier carrying tonner for visualizing an electrostatic latent image formed on the latent image carrier and that includes a side plate unit rotatably supporting the latent image carrier and the developer carrier. The side plate includes a bearing that rotatably supports a rotation shaft of the developer carrier; an elastic body that pushes the bearing against a rotation shaft of the latent image carrier; and a guiding unit that guides the bearing in a direction of the pushing. The guiding unit includes an abrasion preventing structure at a wall surface of the guiding unit that comes in contact with the bearing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are described below with reference to the accompanying drawings.

[1] Structure and Action of Image Forming Apparatus

The structure and the action of an image forming apparatus according to an embodiment of the present invention are explained.

Figure 1:
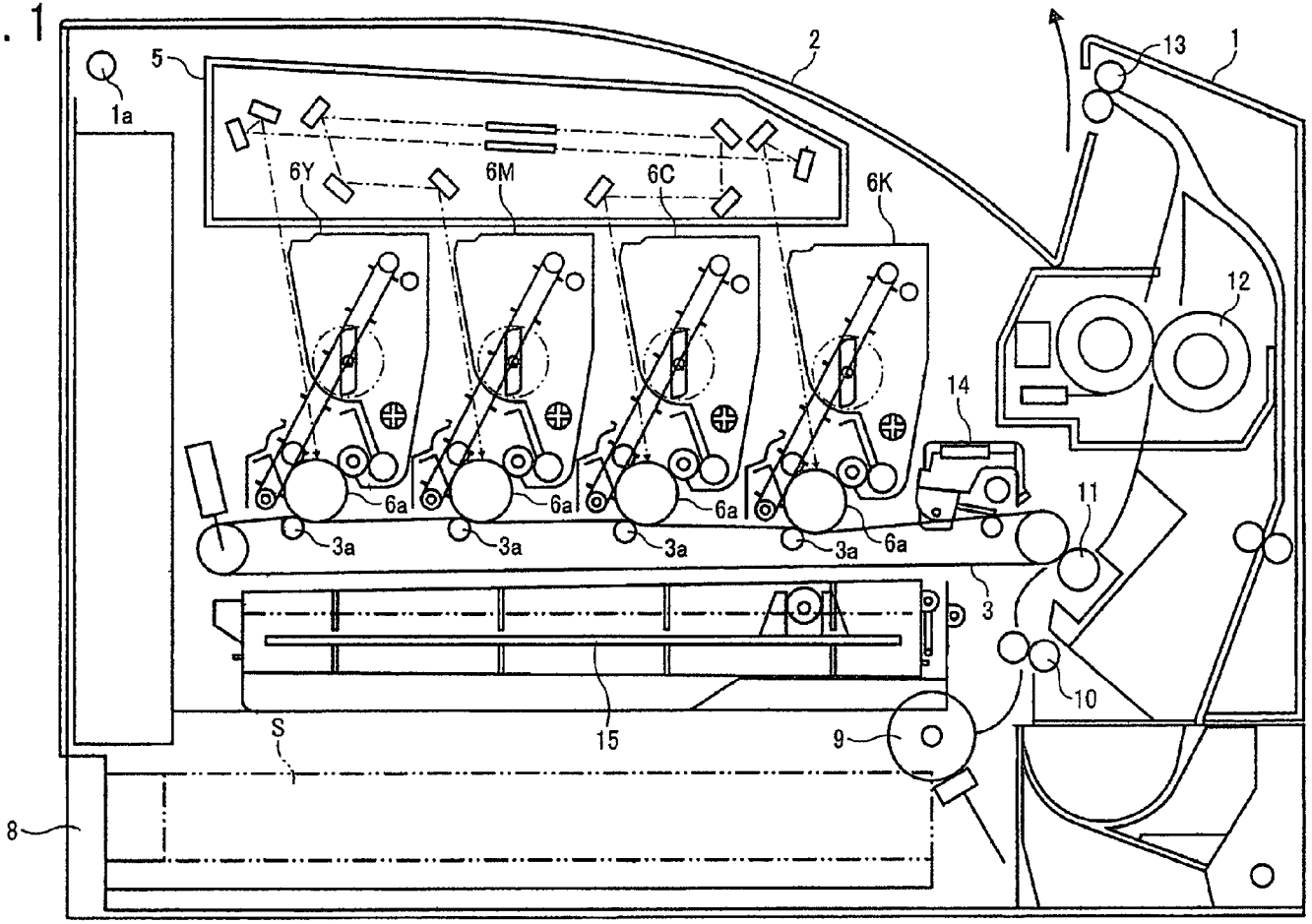
FIG. 1 is a schematic diagram of the whole structure of an image forming apparatus according to an embodiment of the present invention.

FIG. 1 is an example of the image forming apparatus and is a cross-sectional view illustrating the diagrammatic structure of a color electrophotographic apparatus.

In a color electrophotographic apparatus 1, image forming units 6 are arranged in sequence roughly at the center of the frame of the apparatus. An image forming unit for black, an image forming unit for cyan, an image forming unit for magenta, and an image forming unit for yellow are represented as 6K, 6C, 6M, and 6Y, respectively. When the description by color is cumbersome, indexes such as K, C, M, and Y are omitted. Hereinafter, the same meaning shall apply to the other components.

For example, an exposure device 5 for forming a latent image on a latent image carrier 6*a* including a photosensitive drum is arranged above the image forming units 6. A transfer belt 3 supported by support rollers provided at the left and right is arranged below the image forming units 6 in a horizontal direction. The transfer belt 3 is driven to rotate in a counterclockwise direction. A second transfer device 11 that transfers a toner image onto a recording medium as a sheet-like medium is provided to face the support roller provided at the right end of the transfer belt 3. An transfer belt cleaning device 14 is arranged at the position downstream side of the second transfer device 11 and upstream side of the image forming unit for black 6K in a rotation direction of the transfer belt 3.

A used toner recovery container 15 is arranged below the transfer belt 3, and a paper feed cassette 8 that is loaded with and accommodates a recording medium S is arranged below the used toner recovery container 15. The recording medium S fed by a paper feed device 9 that feeds the recording medium S separated into individual sheets passes through between the transfer belt 3 and the second transfer device 11 and is guided to a fixing device 12, and thus, a toner image is thermally fixed on the recording medium S.

The image forming units 6 will be described with reference to FIG. 2.

In the image forming units 6, a toner hopper 6*b* that works with a developing device 16 of each of the image forming unit for black 6K, the image forming unit for cyan 6C, the image forming unit for magenta 6M, and the image forming unit for yellow 6Y is filled with corresponding toner in four different colors (black, cyan, magenta, and yellow) as fine coloring powder.

Around the latent image carrier (in this embodiment, a photosensitive drum) 6*a*, there are arranged: a developing roller 6*h* that serves as a developer carrier supplying toner to the latent image carrier 6*a*; a cleaning blade 6*c* that scrapes off residual toner after the primary transfer in which an image developed with the toner is transferred to the transfer belt is performed; a charging roller 6*d* that makes contact with the latent image carrier 6*a*; a toner feed screw 6*e* that feeds the toner scraped horizontally; a toner feed belt 6*f* by which the toner from the toner feed screw 6*e* is scooped up; and a used toner recovery unit 6*g* by which the toner is recovered.

The process until electrophotographic image formation will be described.

Figure 2:
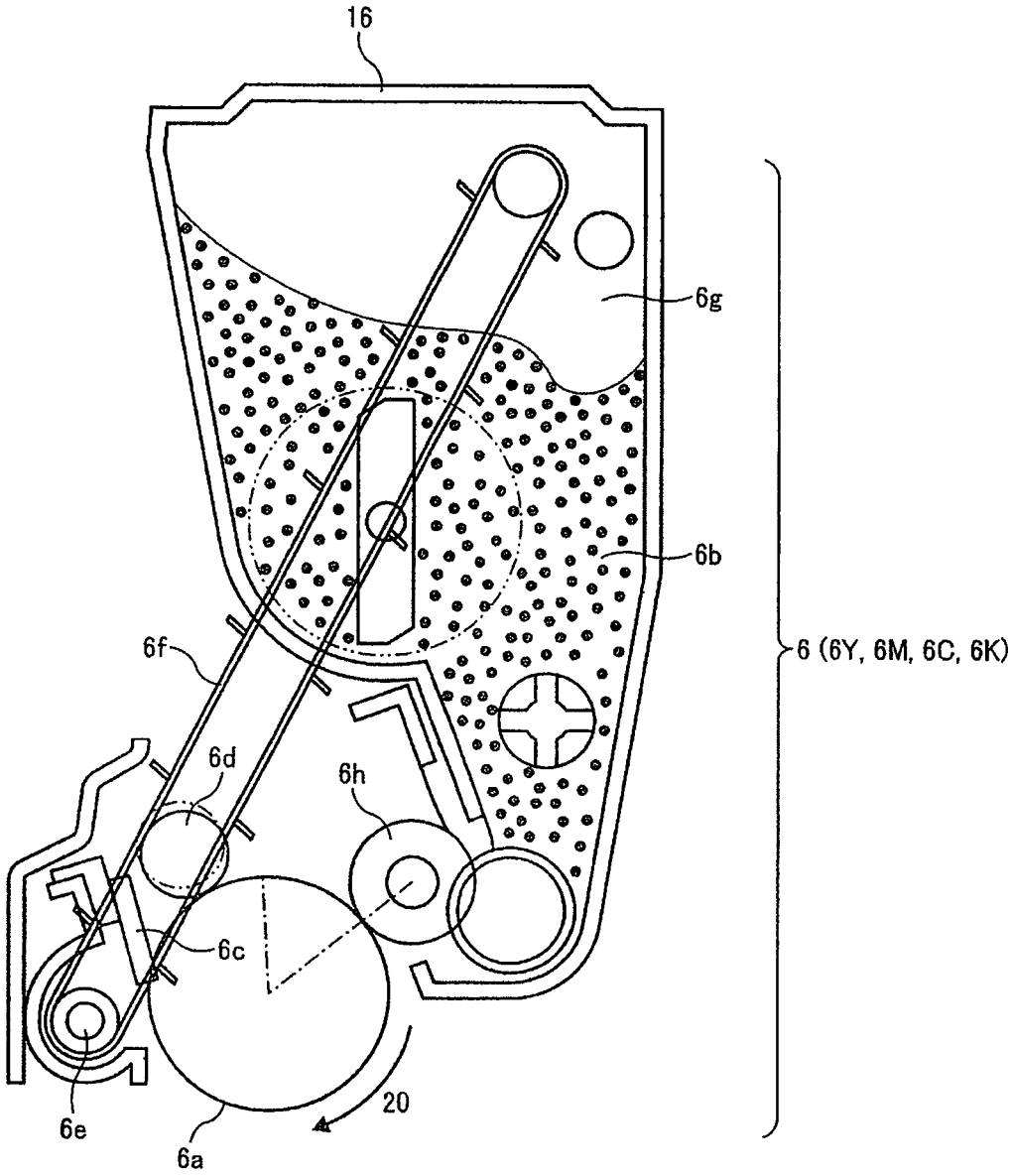
FIG. 2 is a schematic diagram of a structure of a process cartridge used in the image forming apparatus illustrated in FIG. 1.

In FIG. 2, the latent image carrier 6*a* is rotated by a driving device (not illustrated) in the direction indicated by an arrow 20, and the photosensitive layer at the surface of the latent image carrier 6*a* is initialized by being charged to a uniform high potential by the charging roller 6*d*.

In such a manner, the photosensitive layer of the latent image carrier 6*a* charged to a uniform high potential is selectively exposed to scanning exposure light output from the exposure device 5 according to image data. As a result, an electrostatic latent image including a low potential portion whose potential is attenuated by this exposure and a high potential portion produced by the initialization.

When the low potential portion (or the high potential portion) of the electrostatic latent image reaches a contact position with the developing roller 6*h* in which a thin layer of toner is formed on the surface, the toner is transferred to form (develop) a toner image. After this primary transfer, the cleaning blade 6*c* that makes contact with the latent image carrier 6*a* cleans the toner remained on the surface of the latent image carrier 6*a* to allow the subsequent toner image to be formed.

As illustrated in FIG. 1, first transfer rollers 3*a* are arranged at the position where the image forming units 6 make contact with the transfer belt 3. A potential difference is created between the latent image carrier (photosensitive drum) 6*a* and the transfer belt 3 by applying a high potential to the first transfer rollers 3*a* to transfer the toner image formed on the surface of the latent image carrier (photosensitive drum 6*a*).

Each of the image forming units 6K, 6C, 6M, and 6Y transfers a toner image in each color to the transfer belt 3 subsequently, and a color toner image in a plurality of colors in which the monochromatic toner images are superimposed is formed on the transfer belt 3.

The recording medium S such as paper and transparency is fed from the paper feed device 9 and a paper conveying device (facing rollers) 10 to the second transfer position (position where the second transfer device 11 and the transfer belt 3 are opposed to each other) at proper timing. The monochromatic or color toner image formed on the surface of the transfer belt 3 is transferred onto the recording medium S by creating a potential difference between the transfer belt 3 and the second transfer device 11 by applying a high potential to the second transfer device 11.

The recording medium S onto which the toner image is transferred is separated from the transfer belt 3, and the toner image is melted and fixed onto the recording medium S by the fixing device 12. The recording medium S is then discharged to an output tray provided at the top surface of the color electrophotographic apparatus 1 by a paper discharge device (facing rollers) 13.

Excess toner remaining on the surface of the transfer belt 3 after the toner image is transferred to the recording medium S is cleaned off by the transfer belt cleaning device 14 and recovered into the used toner recovery container 15. The cleaned transfer belt 3 is then made ready, for transfer of the subsequent toner image.

Paper jamming during conveying can be prevented, and reliability can be improved by simplifying the conveying path from paper feed (paper feed device 9) of the recording medium S to paper discharge (paper discharge device 13) as far as possible and by increasing the radius of curvature of the conveying path. With this, the remedial operations for removing a paper jam during its occurrence can be simply performed and, furthermore, a color electrophotographic apparatus employing various types of recording media such as thick paper can also be employed.

In an embodiment of the present invention, the recording medium conveying path from paper feed (paper feed device 9) to paper discharge (paper discharge device 13) is formed in substantially arcuate shape, and the transfer belt 3, the image forming units 6, and the exposure device 5 are arranged inside of the recording medium conveying path. With this arrangement, the space within the frame of the apparatus can be effectively utilized to downsize the apparatus, the conveying path is simplified, and a structure with which the recording medium S is discharged with its image surface being directed downwards is achieved.

With such a structure, the conveying path can be simplified, and practically all of the structural units are arranged inside of the conveying path. As a result, the conveying path gets closer to the frame of the apparatus, and therefore, the conveying path can easily be opened, which simplifies the remedial operations for removing a paper jam during its occurrence.

By arranging more than one such recording medium S to be discharged on the color electrophotographic apparatus 1 with their image surfaces being directed downwards, when the recording media S stacked on the color electrophotographic apparatus 1 are removed with their image surfaces directed upwards, the advantage is that the recording media S are stacked to be arranged in the printing order from top to bottom.

Due to the adoption of a structure in which the right side in FIG. 1 is the front face directly opposed to the operator, the remedial actions for removing a paper jam during its occurrence are more simplified.

The top (output tray 2) of the color electrophotographic apparatus 1 has a structure that is opened about a shaft 1*a* at the top left with the exposure device 5 being held, and thus, the operator can replace the image forming units 6 that are consumable from the front face. Due to this front face access structure, in which all of the series of actions can be performed from the front face, a color electrophotographic apparatus can be implemented at any installation location.

When one of the image forming units 6 is constituted as a unit detachable with respect to the image forming apparatus such as the color electrophotographic apparatus 1, such an image forming unit is called a process cartridge. A process cartridge includes at least a latent image carrier and a developing device.

[2] Structure Relating to Sliding of Bearing

In FIG. 2, the developer carrier 6*h* in the developing device 16 has a structure in which the developer carrier 6*h* is separated from the latent image carrier 6*a* by a narrow gap or is in contact with the latent image carrier 6*a*. The structure realizes a latent image on the photosensitive layer provided at the surface of the image carrier 6*a*. The structure of the image forming unit 6 including the developing device 16 is illustrated in disassembled condition in FIG. 3.

Figure 3:
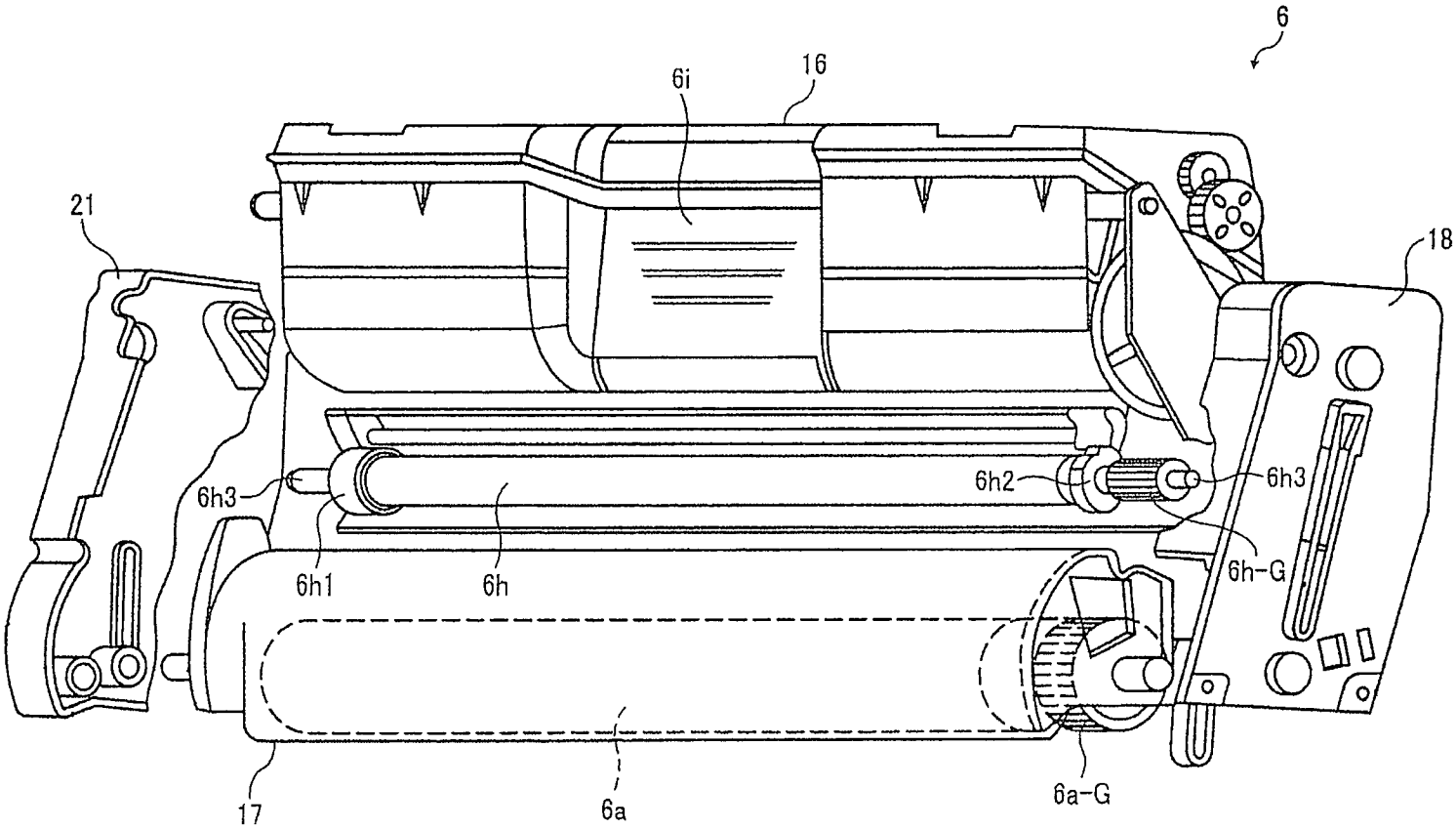
FIG. 3 is an appearance diagram of the process cartridge illustrated in FIG. 2.

In FIG. 3, the image forming unit (process cartridge) 6 is illustrated in a condition disassembled into the four constituent elements of the developing device 16 (also called a developer carrying unit or a developing unit), a latent image carrier unit 17, and a left face plate 18 and a right face plate 21 that support these (the developing device 16 and the latent image carrier unit 17).

In FIG. 3, the developer carrier 6*h* mounted on the developing device 16 is supported on the developing device 16 by the use of bearings 6*h*1 and 6*h*2 for developer carriers that are mounted on the left and right of a developer carrier housing 6*i*. A bearing 18*a* (illustrated in FIG. 4 and described later in detail) for a rotation support shaft that supports a support shaft 6*h*0 (illustrated in FIG. 4 and described later in detail) of the developer carrier 6*h* is provided at the left face plate 18 corresponding to a side plate unit that supports the developer carrier unit 16 and the latent image carrier unit 17. Likewise, the bearing 18*a* for a rotation support shaft (not illustrated) is also provided at the right face plate 21 that supports the developer carrier unit 16 and the latent image carrier unit 17.

Figure 4:
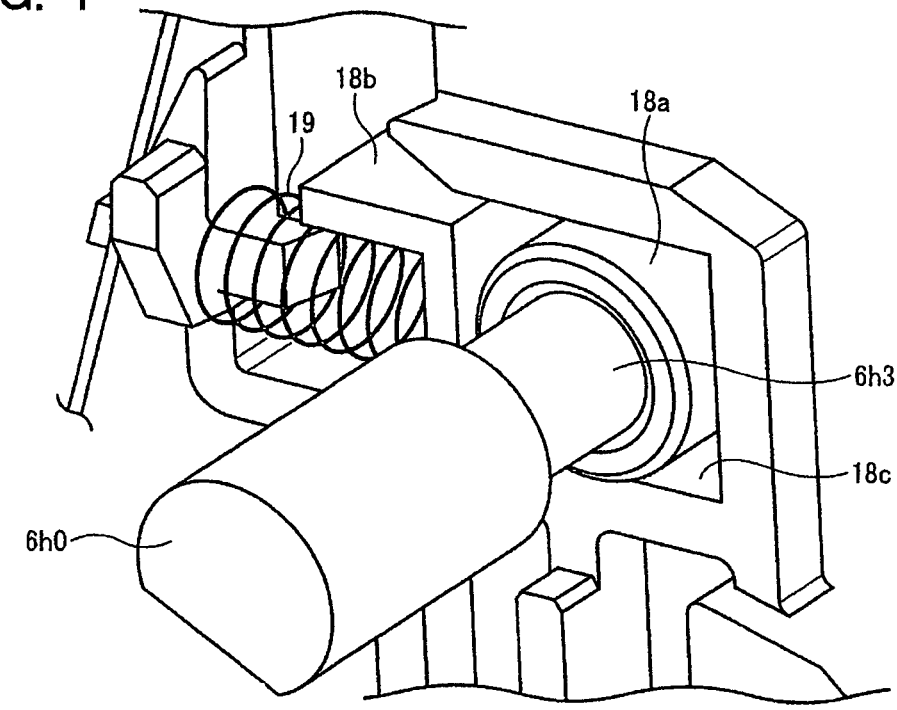
FIG. 4 is a diagram of a structure of a shaft support structure of a developing roller mounted on the process cartridge illustrated in FIG. 3.
Figure 5:
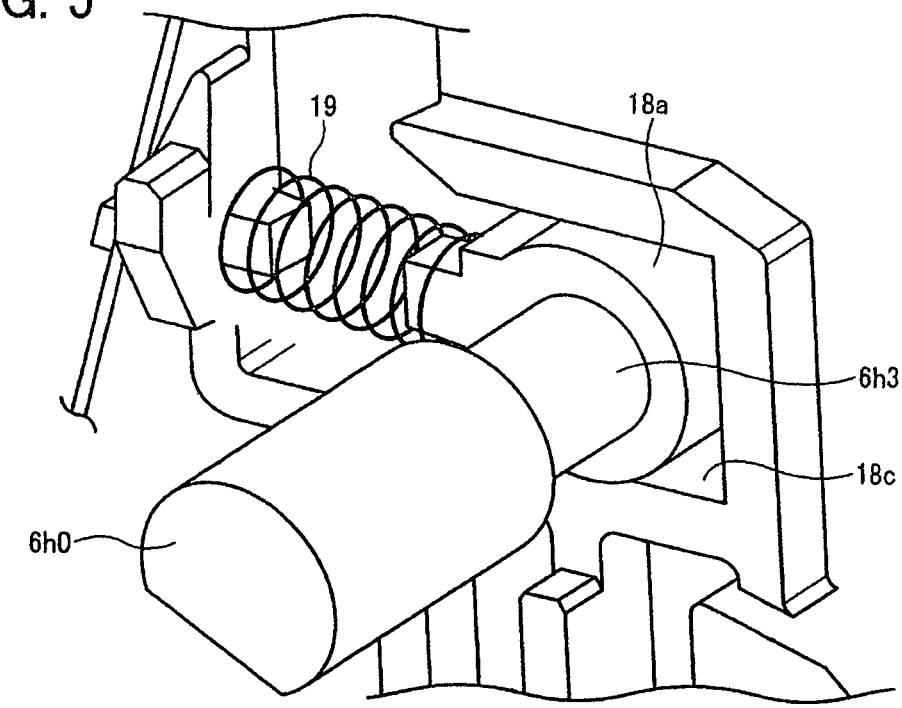
FIG. 5 is a diagram of a modified embodiment of the shaft support structure illustrated in FIG. 3.

A structure of the shaft supporting unit in which the bearing for the support shaft of the developer carrier 6*h* is used employs the structure illustrated in FIG. 4 or 5.

In the structure illustrated in FIG. 4, the shaft end 6*h*3 of the support shaft 6*h*0 fitting with the shaft center portion of the developer carrier 6*h* works with the bearing 18*a*, and the shaft end 6*h*3 itself is rotatable as described in Description of the Related Art of the invention.

The bearing 18*a* is loaded on a guiding unit 18*c* including a grooved portion configured to allow the developer carrier 6*h* to reciprocate toward the latent image carrier 6*a* in the left face plate 18.

The pressing spring 19 is arranged at a portion between an immovable unit of the left face plate 18 and the block body 18*b* arranged so as to come in contact with the peripheral surface of the bearing 18*a* and pushes the bearing 18*a* so as to move the developer carrier 6*h* to the latent image carrier 6*a*.

In contrast, the block body 18*b* illustrated in FIG. 4 is not provided in the structure illustrated in FIG. 5. Instead, a locking portion on which one end of the pressing spring 19 is loaded at a portion of the peripheral surface of the locking portion is formed on a bearing (represented as a reference numeral 18*a*' for convenience). Therefore, the bearing itself does not rotate unlike the bearing illustrated in FIG. 4. With the structure illustrated in FIG. 5, the shaft end 6*h*3 of the support shaft 6*h*0 does not work with the bearing 18*a*', and the support shaft 6*h*0 can rotate at the inside of the bearing 18*a*'.

The feature of the embodiment will be described with reference to such structures.

Figure 12:
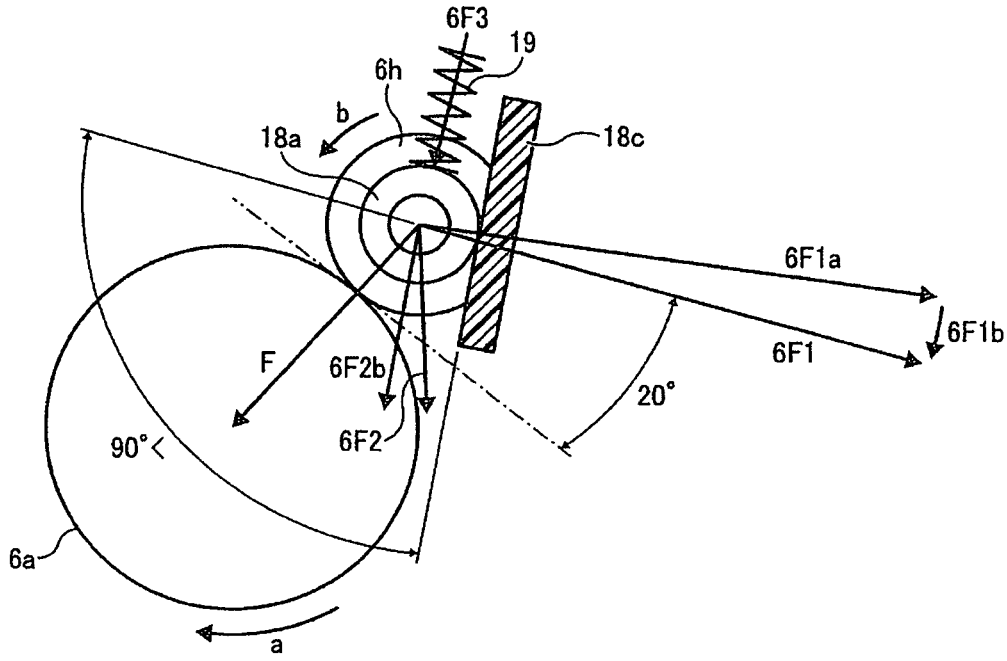
FIG. 12 is a schematic diagram for explaining force relationship that acts between a developing roller and a guiding unit illustrated in FIG. 4 on which the shaft unit of the developing roller is loaded.

In the shaft support structures illustrated in FIGS. 4 and 5, force that presses the wall surface of the guiding unit 18*c* is generated according to the force relationship described referring to FIG. 12. Therefore, in the embodiment, an abrasion preventing structure is used for the wall surface of the guiding unit 18*c* that comes in contact with and is pressed by the bearings 18*a* and 18*a*' by a component of force obtained from the weight of the developing device including the developer carrier 6*h* and the rotation force of the developer carrier 6*h*.

Figure 6:
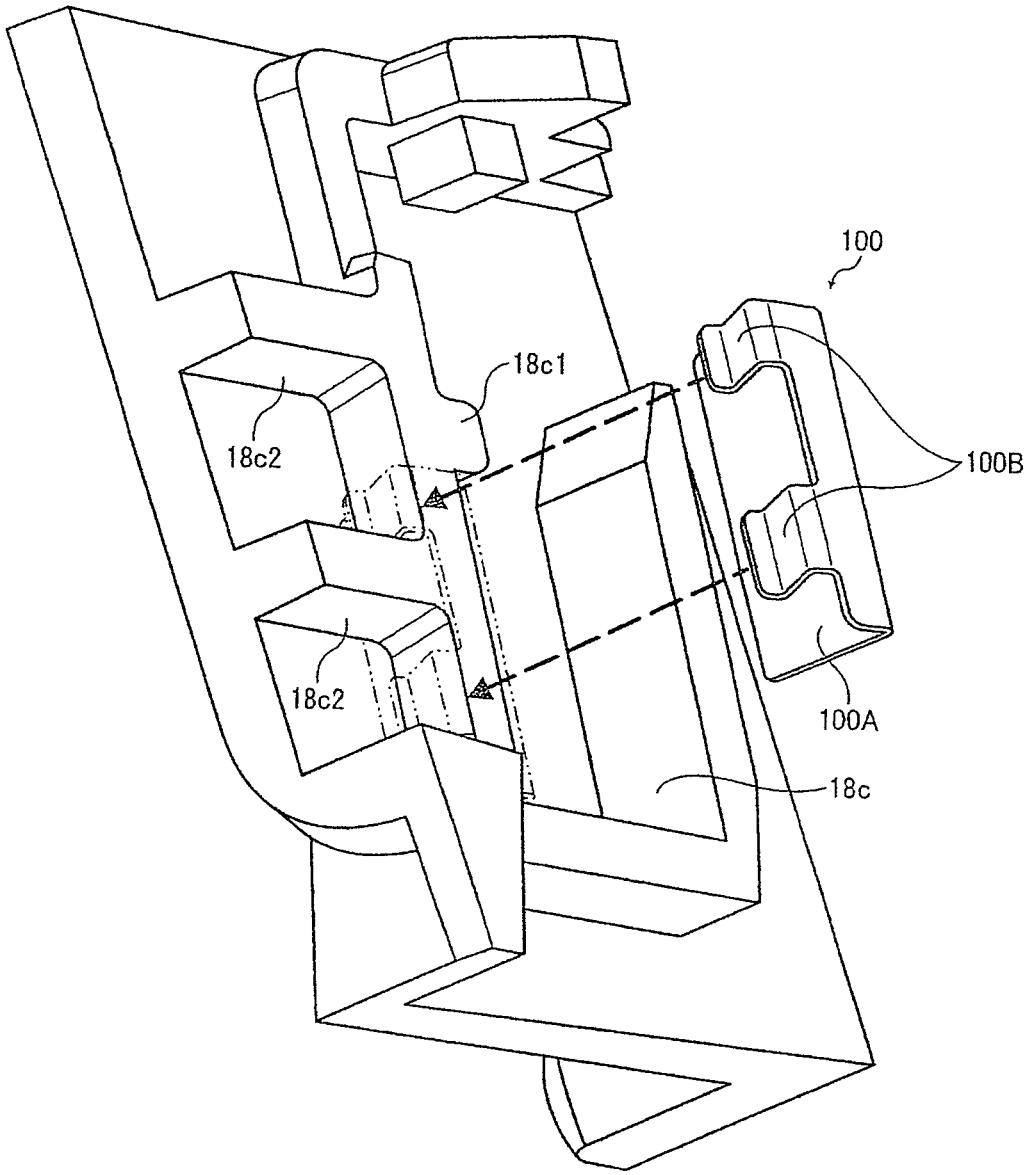
FIG. 6 is a schematic corresponding to FIG. 3 for explaining a structure of a substantial portion of the process cartridge according to the embodiment.

As illustrated in FIG. 6, a plate-like member 100 that has a surface coming in contact with the bearing according to the force relationship as described above is used in the abrasion preventing structure.

The cross-section shape of the plate-like member 100 is formed in a channel shape, one of opposed pieces is a contact surface 100A that makes contact with the bearing 18*a*, and the other of the opposed pieces facing the contact surface is a pair of pinching pieces 100B that can be embedded into the wall surface of the guiding unit and that can pinch the wall surface.

The pinching pieces 100B oppose the contact surface 100A and is embedded into the rib of the wall surface (represented as a reference numeral 18*c*1 for convenience) to thereby maintain a state of coming in contact with the wall surface. Subsequently, the plate-like member 100 is maintained in an immovable state. In other words, the plate-like member 100 is used as a member detachable to the wall surface by embedding the pinching pieces 100B in the wall surface. When the plate-like member 100 is embedded, it can be maintained in an immovable state even when the bearing contacts and presses the contact surface 100A.

The reason that the opposed state of the bearing and the plate-like member can be maintained will be described below with reference to FIGS. 7 and 8.

Figure 7:
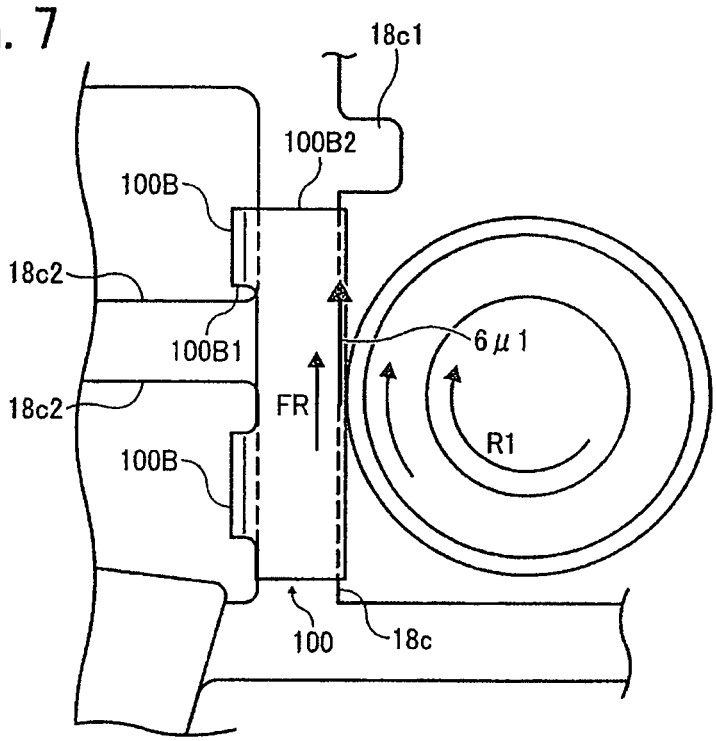
FIG. 7 is a schematic corresponding to FIG. 3 for explaining a modified embodiment of a structure of a substantial portion of the process cartridge according to the embodiment.
Figure 8:
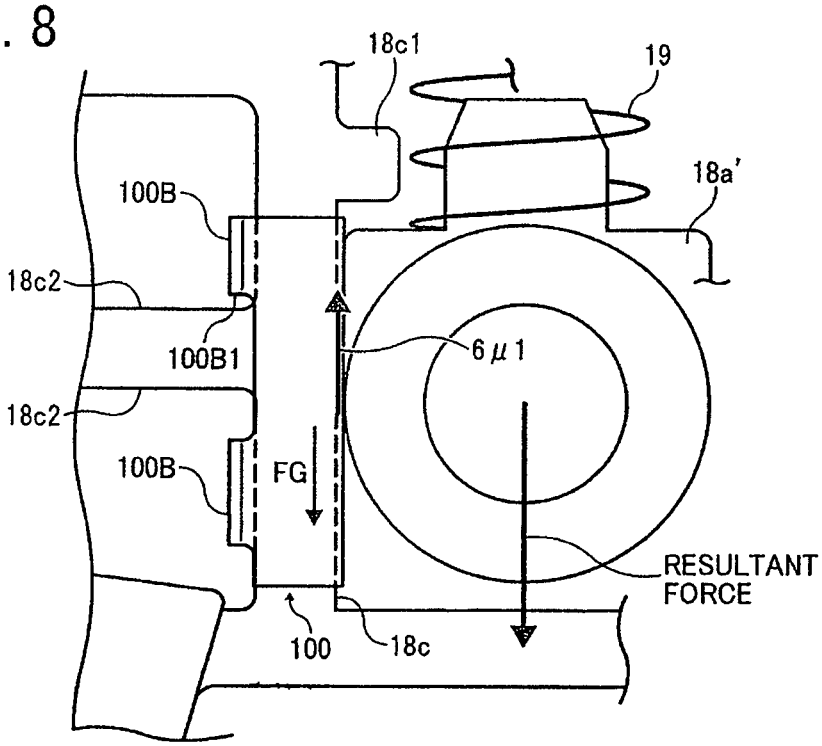
FIG. 8 is an elevation for explaining an action of the structure illustrated in FIG. 6.

FIGS. 7 and 8 are schematics for explaining force relationship that acts on the bearings 18*a* and 18*a*' in which the bearing 18*a* has a structure illustrated in FIG. 4, and the bearing 18*a*' has a structure illustrated in FIG. 5.

Force represented as a reference numeral 6μ1 in FIG. 8 is frictional force obtained from a resultant force of a component of driving force that generates in the bearing, a component of force of own weight of the developing device, and a pressing force by the spring as described with reference to FIG. 12. Therefore, the plate-like member 100 receives force that makes the plate-like member 100 slide in a direction represented as a reference numeral FG due to the difference between the resultant force and the frictional force.

When the bearing rotates in a direction of an arrow R1, the plate-like member 100 receives force that makes the plate-like member 100 slide in a direction represented as a reference numeral FR in FIG. 7.

In consideration of generation of the force that makes the plate-like member 100 slide, in the embodiment, the plate-like member 100 is constructed such that, when the force (FR)

acts on the plate-like member 100 and slides it, an edge 100B2 at the front-side in a sliding direction bumps into the bottom surface of one of the rib portions 18*c*1 of the guiding unit 18*c*. Thus, the bearing is made not to be apart from the contact surface 100A even when the force FR as illustrated in FIG. 7 acts on the plate-like member.

Furthermore, in consideration of generation of the force (FG) as illustrated in FIG. 8, in the embodiment, the plate-like member 100 is also constructed such that, when the force FG acts on the plate-like member 100 and slide it, one of the pinching pieces 100B bumps into one of other rib portions 18*c*2 of the guiding unit 18*c*. Thus, the bearing 18*a* is made not to be apart from the contact surface 100A even when the force FG as illustrated in FIG. 8 acts on the plate-like member. The length of the contact surface 100A in its sliding direction and the width between the ribs 18*c*2 are set to maintain such a state that the bearing is not apart from the contact surface 100A.

Figure 9:
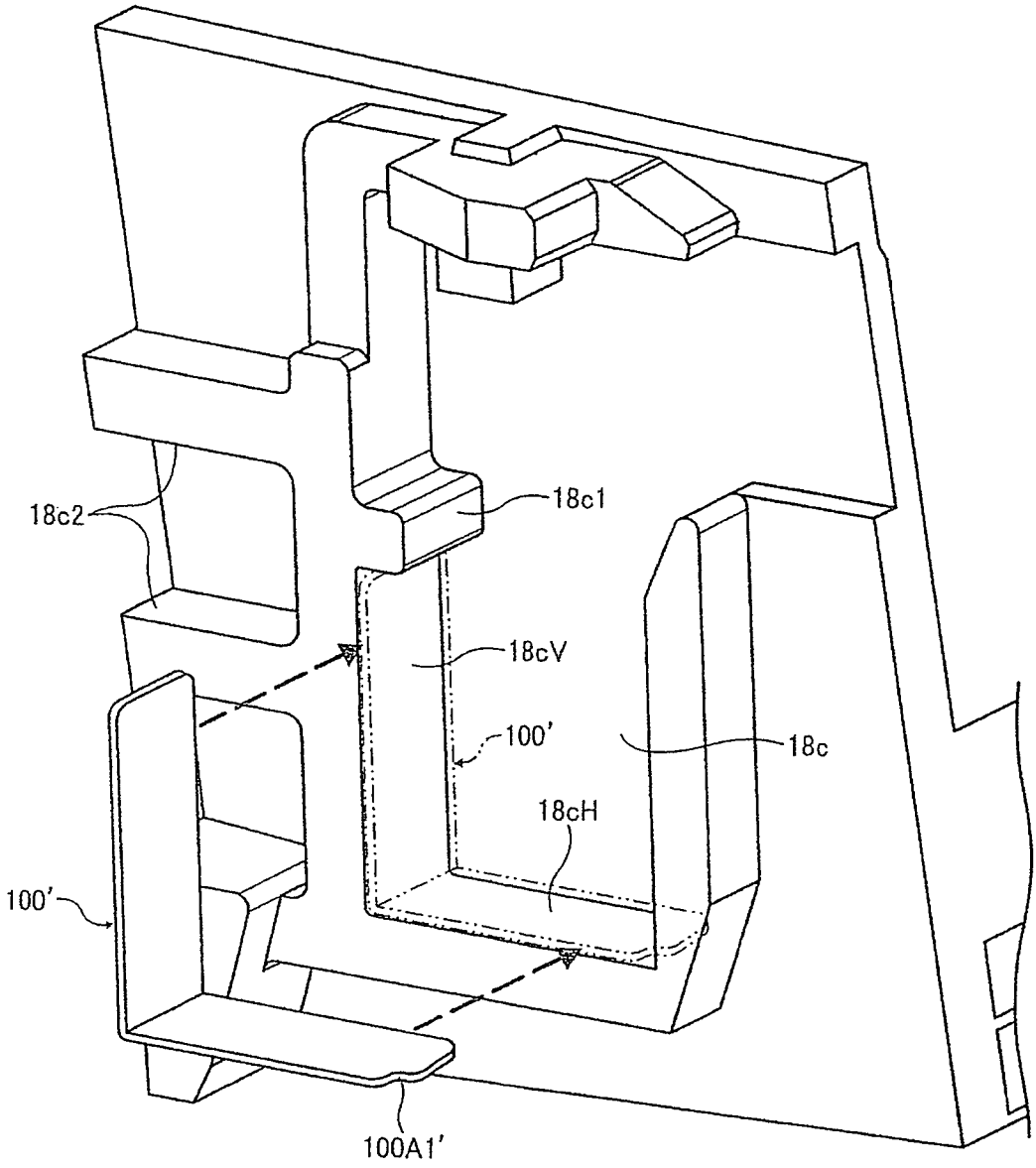
FIG. 9 is an elevation for explaining another action of the structure illustrated in FIG. 6.

FIG. 9 is a schematic of a modified embodiment of the plate-like member described above (represented as a reference numeral 100' for convenience). The plate-like member 100' in FIG. 9 is processed by being bended at a right angle along with right-angled wall surfaces 18*c*H, 18*c*V formed at the guiding unit 18*c*.

A locking portion 100A1' formed with a concave notch that can prevent the plate-like member 100' from falling off by being hooked on the side portion of the wall surface of the guiding unit is formed at one corner of the plate-like member 100'.

When the plate-like member 100' illustrated in FIG. 9 is used, a structure for preventing sliding deflection caused by force acting on the plate-like member 100' is also employed as with the plate-like members illustrated in FIGS. 7 and 8.

Figure 10:
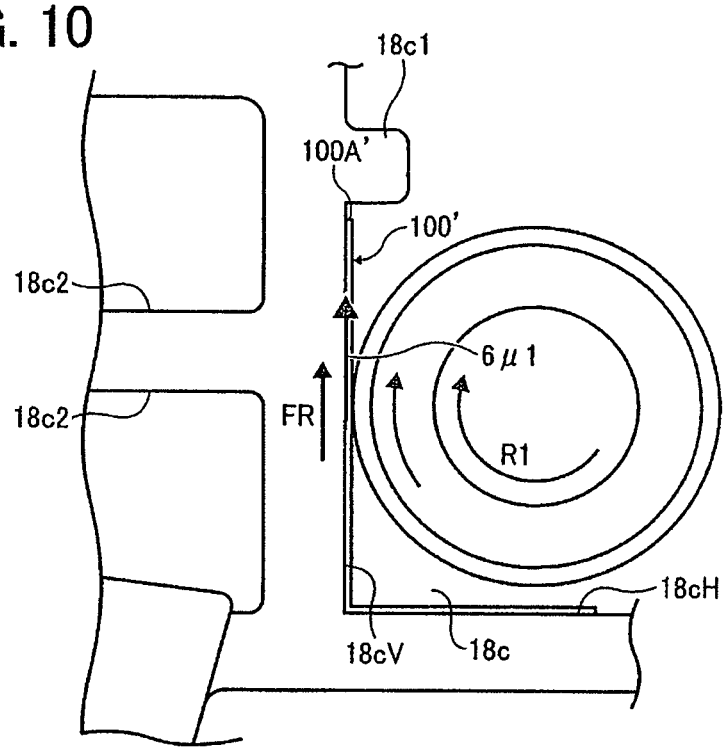
FIG. 10 is an elevation corresponding to FIG. 7 for explaining an action of the structure illustrated in FIG. 7.
Figure 11:
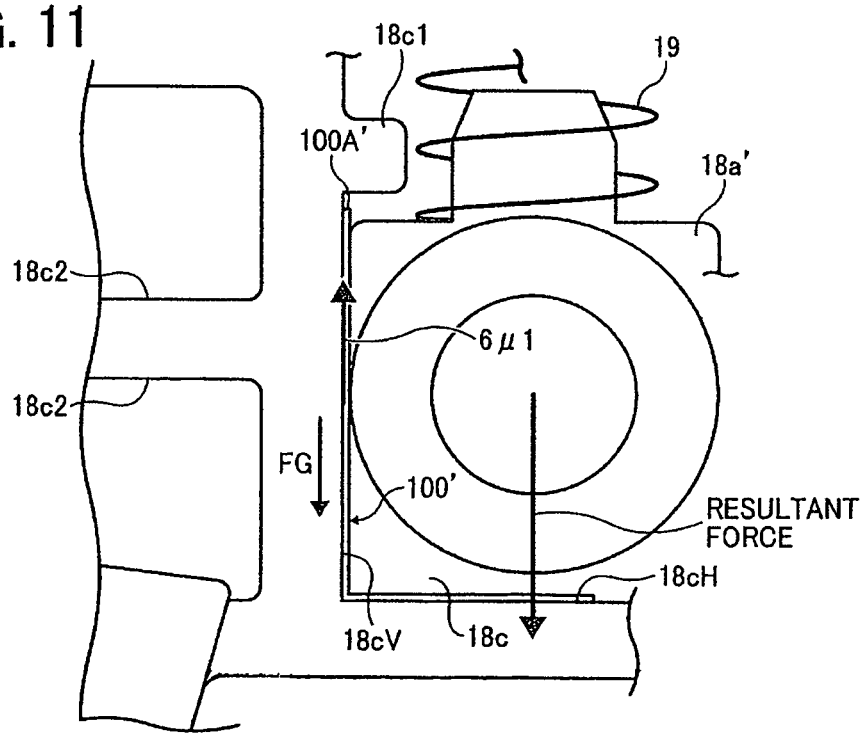
FIG. 11 is an elevation corresponding to FIG. 8 for explaining another action of the structure illustrated in FIG. 8.

FIG. 10 is a schematic regarding the bearing 18*a* having a structure illustrated in FIG. 4, and FIG. 11 is a schematic regarding the bearing 18*a'* having a structure illustrated in FIG. 5.

The force represented as a reference numeral 6μ1 in FIG. 11 is frictional force obtained from a resultant force of a component of driving force that generates in the bearing, a component of force of own weight of the developing device, and a pressing force by the spring as described with reference to FIG. 12. Therefore, the plate-like member 100' receives force that makes the plate-like member 100' slide in a direction represented as the reference numeral FG due to the difference between the resultant force and the frictional force.

When the bearing rotates in a direction of the arrow R1, the plate-like member 100' receives force that makes the plate-like member 100' slide in a direction represented as the reference numeral FR in FIG. 10 as with the plate-like member 100 illustrated in FIG. 7.

In consideration of the generation of the force that makes the plate-like member 100' slide, in the embodiment, the plate-like member 100' 11 is constructed such that, when the force (FG) acts on the plate-like member 100' and slides it, the bended piece at the front-side in a sliding direction bumps into the wall surface 18*c*H of the guiding unit 18*c*. Thus, the bearing is made not to be apart from the plate-like member 100'.

Furthermore, in consideration of generation of the force (FR) as illustrated in FIG. 10, the plate-like member 100' is also constructed such that, when the force FR acts on the plate-like member 100', a edge surface 100A' of the plate-like member 100' in a sliding direction bumps into one of the rib portions 18*c*1 of the guiding unit 18*c*. Thus, the bearing 18*a'* is made not to be apart from the contact surface 100A'. The length of the contact surface 100A' in its sliding direction and the width between the ribs 18*c*2 are set to maintain such a state that the bearing 18*a'* is not apart from the contact surface 100A.

The present invention can prevent the abrasion of the wall surface caused by contact with the bearing. This prevention suppresses the change of the distance between the shafts of the latent image carrier and the developer carrier caused by deformation, crack, or the like due to the abrasion of the wall surface. Accordingly, generation of image degradation due to supply irregularity of the developer caused by the change of the distance between the shafts can be prevented.

Moreover, the plate-like member prevents the sliding between the wall surface and the bearing and can also be used when the abrasion of the wall surface is repaired. Therefore, new component replacement or the like is not required, and the state without abrasion can be maintained for a long period.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge that collectively accommodates at least a latent image carrier and a developer carrier carrying tonner for visualizing an electrostatic latent image formed on the latent image carrier, the process cartridge comprising:

a side plate unit rotatably supporting the latent image carrier and the developer carrier, the side plate including a bearing that rotatably supports a rotation shaft of the developer carrier;

an elastic body that pushes the bearing toward the latent image carrier; and a guiding unit that guides the bearing in a direction of the pushing, wherein the guiding unit includes an abrasion preventing structure at a wall surface of the guiding unit that comes in contact with the bearing, and the abrasion preventing structure includes a plate-like member that is detachable to the wall surface and has a surface capable of contacting a peripheral surface of the bearing.

2. The process cartridge according to claim 1, wherein the plate-like member of the abrasion preventing structure includes an attachment part capable of maintaining the plate-like member in an immovable state by pinching a portion of the wall surface.

3. The process cartridge according to claim 1, wherein the plate-like member of the abrasion preventing structure includes a falling off preventing piece capable of locking the plate-like member at a portion of the wall surface.

4. The process cartridge according to claim 1, wherein the plate-like member of the abrasion preventing structure is capable of being retrofitted with the wall surface of the guiding unit.

5. The process cartridge according to claim 1, wherein the bearing has a structure to be loaded on the guiding unit in a state where the bearing rotatably works with the rotation shaft of the developer carrier.

6. The process cartridge according to claim 1, wherein the bearing has a structure, a portion of which fits the elastic body and which is capable of moving back and forth in the direction of the pushing against the guiding unit.

7. The process cartridge according to claim 1, wherein the bearing comes in contact with the wall surface of the guiding unit by a component of force obtained from rotating force and own weight of the developer carrier.

8. An image forming apparatus comprising the process cartridge according to claim 1.

9. The image forming apparatus according to claim 8, wherein the image forming apparatus comprises the process cartridge in plurality and is capable of forming an image in a plurality of colors.

* * * * *